United States Patent [19]

Przirembel

[11] 4,017,213

[45] Apr. 12, 1977

[54] TURBOMACHINERY VANE OR BLADE WITH COOLED PLATFORMS

[75] Inventor: Hans Rainer Przirembel, Hebron, Conn.

[73] Assignee: United Technologies Corporation, Hartford, Conn.

[22] Filed: Oct. 14, 1975

[21] Appl. No.: 622,322

[52] U.S. Cl. ..... 416/97 A; 415/115

[51] Int. Cl.[2] ..... F01D 5/18

[58] Field of Search ..... 415/115, 116; 416/96, 416/97, 95

[56] References Cited

UNITED STATES PATENTS

| | | | |
|---|---|---|---|
| 3,433,015 | 3/1969 | Sneeden | 415/115 X |
| 3,515,499 | 6/1970 | Beer et al. | 416/97 A X |
| 3,527,543 | 9/1970 | Howald | 415/115 X |
| 3,529,902 | 9/1970 | Emmerson et al. | 416/95 X |
| 3,610,769 | 10/1971 | Schwedland et al. | 415/115 |
| 3,628,880 | 12/1971 | Smuland et al. | 415/115 |
| 3,644,060 | 2/1972 | Bryan | 416/97 |
| 3,726,604 | 4/1973 | Helms et al. | 415/115 |
| 3,800,864 | 4/1974 | Hauser et al. | 415/115 X |

*Primary Examiner*—Everette A. Powell, Jr.
*Attorney, Agent, or Firm*—Vernon F. Hauschild

[57] ABSTRACT

A turbomachinery vane or blade with cooled platforms including provision for film cooling the inner and outer surfaces of the platform forward portion, including cooling fluid cavities in the platform on both the pressure and suction sides of the vane or blade airfoil for cooling this region of the platform by a combination of impingement, convection and film cooling, and a selective array of drilled holes extending through the platform trailing edge for convection cooling thereof.

19 Claims, 8 Drawing Figures

FIG. 1
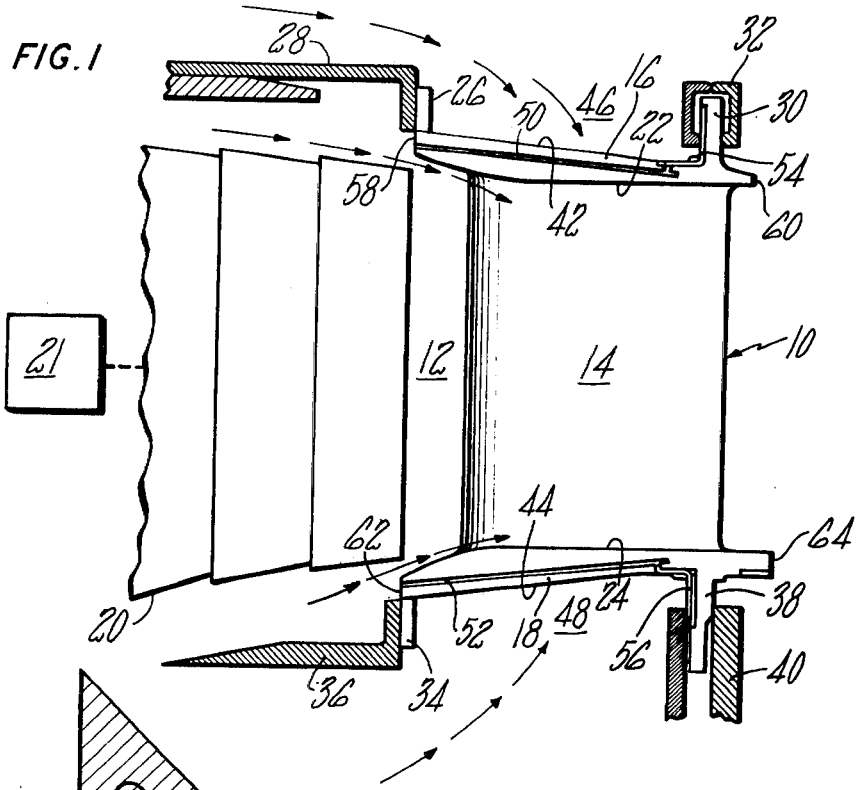
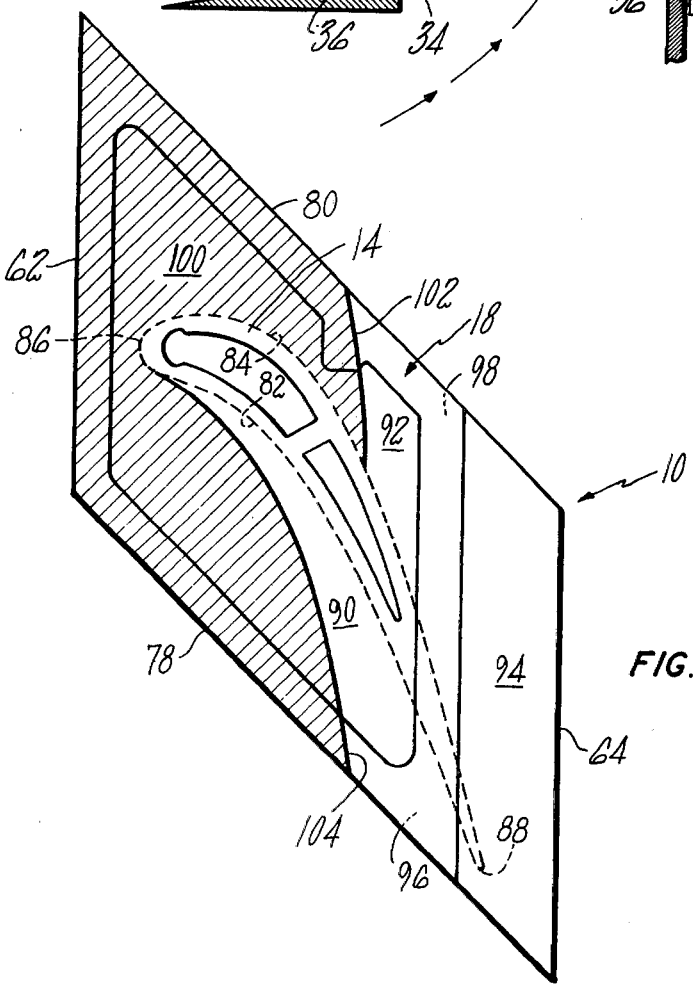
FIG. 3

TURBOMACHINERY VANE OR BLADE WITH COOLED PLATFORMS

CROSS-REFERENCE TO RELATED APPLICATIONS

Some of the subject matter disclosed and claimed in this application is included in an application filed on even date herewith entitled "Turbomachinery Vane or Blade With Cooled Platforms" in the name of Melvin L. Noble.

BACKGROUND OF THE INVENTION

1. Field of the Invention

This invention relates to the cooling of turbomachinery vane or blade platforms or shrouds and more particularly to apparatus in which the platform is cooled by a combination of film, convection and impingement cooling and wherein discrete sections of the platform are provided with cooling mechanisms particularly suited to the cooling requirements of that discrete platform section.

2. Description of the Prior Art

In the vane or blade platform cooling art, many attempts have been made to adequately cool the platforms of vanes or blades, which are subjected to ever increasing temperatures as the power generated by turbomachinery increases with technological advances. Bluck U.S. Pat. No. 3,066,910 passes coolant through passages in the blade platform but this is a utilization of convection cooling only. Howard U.S. Pat. No. 3,527,543 discharges cooling air along the surface of a vane platform but this teaching utilizes film cooling only. French U.S. Pat. No. 1,214,618, which was published on Apr. 11, 1960, passes cooling air through passages adjacent the vane platform but this is a utilization of convection cooling only. Other patents such as U.S. Pat. Nos. 3,656,863; 3,318,573; 3,290,004; 2,828,940; 3,446,480; 3,446,482; and 3,446,481 all attempt to cool vane or blade platforms but none use the structure and combination of cooling principles taught herein.

SUMMARY OF THE INVENTION

A primary object of the present invention is to provide a cooled turbomachinery vane or blade platform which is cooled by a combination of film, convection and impingement cooling and which has discrete cooling regions within the platform specifically adapted to suit the cooling requirements of that portion of the platform.

In accordance with the present invention, discrete sections of the platform are cooled by independent cooling means adapted for the particular requirement of that portion of the platform.

In accordance with a further aspect of the present invention, the forward portion of the platform is cooled by film cooling, the central portion of the platform adjacent the airfoil pressure side is cooled by a combination of impingement, convection and film cooling, the central portion of the platform adjacent the airfoil suction side is cooled by a combination of impingement, convection and film cooling, and the trailing or after portion of the platform is cooled by convection cooling.

Other objects and advantages of the present invention may be seen by referring to the following description and claims, read in conjunction with the accompanying drawings.

BRIEF DESCRIPTION OF THE DRAWINGS

FIG. 1 is a showing of a turbomachinery airfoil member utilizing my invention.

FIG. 3 is a top or bottom view of such an airfoil member to illustrate the platform cooling regions.

DESCRIPTION OF THE PREFERRED EMBODIMENT

Figure 2:
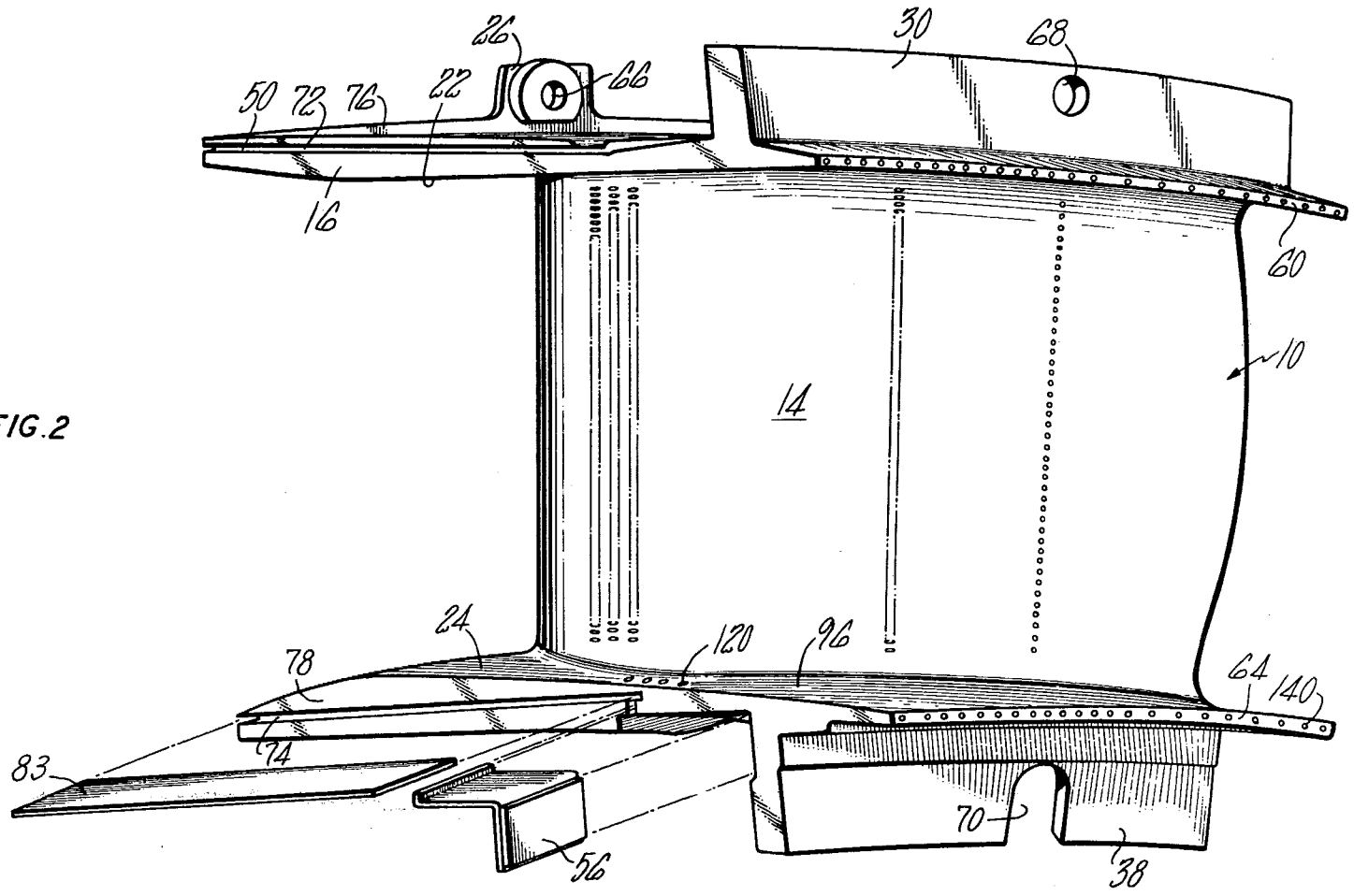
FIG. 2 is a perspective showing of such a turbomachinery airfoil member.

Referring to FIG. 1, we see airfoil member 10, which is illustrated to be a stationary vane of the type used in turbine engines such as those illustrated in U.S. Pat. Nos. 2,711,631 and 2,747,367, but which could also be a rotating blade therein. Vane 10 will be described as if positioned at the inlet to the turbine section of a turbine engine but it should be borne in mind that it could be positioned elsewhere in either the turbine or compressor section of a conventional turbine engine. Vane 10 is one of a plurality of vanes which extends substantially radially with respect to the engine centerline and which are positioned in a circumferential array thereabout to extend across annular hot gas passage 12 of the turbine or compressor portion of turbomachinery. Vane 10 has an airfoil section 14 which extends between outer platform or shroud 16 and inner platform or shroud 18 in conventional fashion. Vane 10 receives the turbomachinery hot gas from duct member 20 upstream thereof, which hot gas in passing through annular hot gas passage 12 passes across vane 10 to be discharged downstream of the vane in conventional fashion against the blades or buckets of a compressor or turbine rotor at optimum incident angle. Duct 20 is possibly a transition duct joining the combustion chamber section of turbomachinery to the turbine section thereof so that it will be realized that the gas passing through passage 12 and across the airfoil sections 14 of vanes 10 is extremely hot. Vanes 14 and transition duct 20 are part of conventional turbine 21. The inlet to the turbine is generally considered to be the portion of a turbine engine which is subjected to the hottest temperatures and the temperature which the turbine inlet, such as vane 10, can withstand is an important criterion in determining the power which a turbine engine can produce. It is accordingly conventional practice to cool airfoil section 14 of vane 10 and the teaching of this application is to cool one or both of vane platforms 16 and 18, as well. It will be realized that these platforms are subjected to the temperature of the hot gases passing through passage 12 and over vane airfoil section 14 since platform surfaces 22 and 24 form the radial boundaries of hot gas passage 12.

As best shown in FIG. 1, vane 10 can be supported in any conventional fashion so as to extend substantially radially across passage 12 but preferably outer platform 16 has forward flange 26 connected in conventional fashion to support 28 and after flange 30 is supported in conventional fashion from support means 32.

Similarly, inner platform 18 has forward flange 34 supported in conventional fashion from support means 36, and after flange 38 supported in conventional fashion from support means 40. Support means 28, 32, 36 and 40 are supported in conventional fashion from the turbomachinery 21 in which vane 10 is located. It will further be noted by viewing FIG. 1 that, as shown by the arrows, cooling fluid in the form of a cooling air which passes around the turbomachinery combustion chamber flows over both the inner surfaces 22 and 24 of platforms 16 and 18 for film cooling of these surfaces. This cooling air which enters regions 46 and 48 will be used in a fashion to be described hereinafter to further cool platforms 16 and 18. A series of seals, such as feather seals 50 and 52, and seals 54 and 56 serve to prevent the hot gases from passage 12 from passing between adjacent vanes 10 and into areas 46 and 48. The seals not only serve to cause the hot gases to perform their intended power generating function in passage 12 but also serve to prevent the hot gases from passage 12 from heating the cooling air in areas 46 and 48 and thereby reducing the efficiency of the cooling system.

As shown in FIG. 1, platform 16 has a leading edge 58 and a trailing edge 60, while platform 18 has a leading edge 62 and a trailing edge 64.

FIG. 2 shows vane 10 in perspective view and the reference numerals used to identify the portions thereof in FIG. 1 are used to identify corresponding portions in FIG. 2. FIG. 2 shows that a conventional securing member may be passed through aperture 66 of flange 26 to secure platform 16 to attachment means 28, may also be passed through aperture 68 of flange 30 and connected to attachment means 32, and may be passed through slot 70 in flange 38 to attachment means 40. Feather seals 50 and 52 are generally of the same construction and consist of slots 72 and 74 in the lateral edges 76 and 78 of platform 16 and 18, and corresponding slots in the opposite lateral edges, such as 80 of FIG. 3, so that feather seal or strip 83 extends into aligned substantially axially extending slots, such as 74 and 80, of adjacent vane outer platforms 18 so as to prevent hot gas flow therebetween from hot gas passage 12. Seal 56 is held in position by attachment means 40 and extends between adjacent lateral surfaces of adjacent vanes 10 to perform the same function, as does outer seal 54.

From this point on in this description, the cooling of inner platform 18 only will be described but it should be borne in mind that outer platform 16 can be similarly cooled using precisely the same construction now to be described in connection with platform 18, can be cooled by other conventional cooling methods, or can be uncooled.

Referring to FIG. 3 we see a bottom view of the cooling function portion of platform or shroud 18. Platform 18 is preferably interconnected integrally with vane airfoil section 14, which consists of pressure side 82 and suction side 84, leading edge 86 and trailing edge 88. Airfoil section 14 is preferably cooled in some fashion which forms no part of this invention. It will be noted that pressure side platform cooling cavity 90 is located in platform 18 adjacent pressure side 82 of vane airfoil section 14, while suction side cooling air cavity or chamber 92 is positioned adjacent the suction side 84 of the airfoil section 14 of vane 10. The portion of platform 18 which is generally downstream of airfoil section 14 is the platform trailing edge area 94. The surface of the platform adjacent pressure side lateral edge 78 and suction side lateral edge 80, and which form part of surface 24 are called the platform pressure side rail 96 and the platform suction side rail 98, respectively. FIG. 3 is used principally to illustrate that platform 18 is being cooled in different ways in four different regions by four distinct and independent cooling structures. The first of these regions is the forward platform region 100 shown crossed hatch for illustration purposes in FIG. 3 and bounded by forward edge 62, lateral edges 78 and 80 and, at its downstream edge, by temperature limit lines 102 and 104, and airfoil section 14. This forward platform region 100 is film cooled on both inner surface 24 and inner surface 24 by cool air from the combustion chamber region shown in arrows in FIG. 1. The platform pressure side region, which includes pressure side cooling cavity or chamber 90, is cooled as described hereinafter by a combination of impingement, convection and film cooling. The platform suction side region which includes suction side cooling air cavity or chamber 92 is also cooled as described hereinafter by a combination of impingement, convection and film cooling. Platform trailing edge region 94 is cooled as described hereinafter by an array of drilled convection holes.

Figures 4, 5, 6, 7, 8:
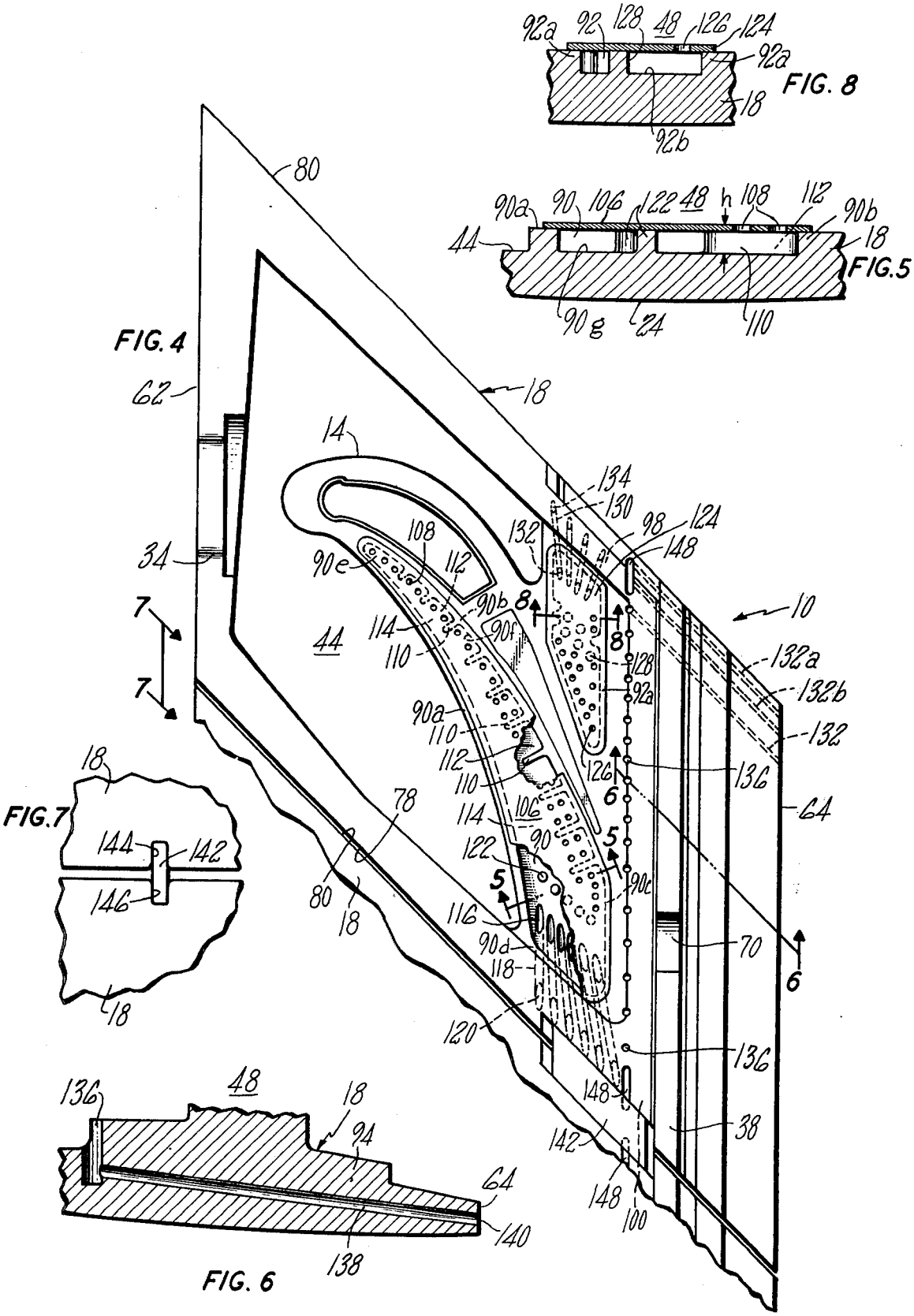
FIG. 4 is a top or bottom view of the platform of the airfoil member showing the cooling arrangement thereof.
FIG. 5 is a view taken along line 5—5 of FIG. 4.
FIG. 6 is a view taken along line 6—6 of FIG. 4.
FIG. 7 is a view taken along line 7—7 of FIG. 4.
FIG. 8 is a view taken along line 8—8 of FIG. 4.

Referring to FIG. 4 we see the details of construction of the cooling schemes for the pressure side, the suction side and the trailing edge portion of platform 18. Pressure side cooling chamber or cavity 90 is preferably bounded in part by continuous or joined raised ribs **90*a*, 90*b*, 90*c* and 90*d*, which are cast as an integral part of vane 10, which is preferably a casting and project outwardly from surface 44. Impingement plate 106 is shaped to the contour of chamber 90 and is joined to raised ribs 90*a*, 90*b*, 90*c* and 90*d* in any convenient fashion, such as welding, so as to form sealed cooling chamber 90 therebetween. By viewing FIG. 4 it will be noted that cooling chamber 90 extends along the pressure side 82 of airfoil section 14 of vane 10 for substantially the full chord dimension thereof, is of minimum lateral dimension at its forward end 90*e* and increases in lateral dimension as it projects toward platform trailing edge 64. Impingement plate 106 includes a plurality of impingement holes 108, thus shown in FIG. 5, but which are preferably of a selected array as shown in FIG. 4 along the airfoil pressure side 90*f* of cavity 90. A plurality of dams or ribs 110 project laterally outwardly from the pressure side 90*f* of cavity 90 toward the center of cavity 90 and extend for the full height $h$ thereof between bottom surface 90*g*, which is actually part of outer surface 44, of cavity 90 and impingement plate 106 so as to form discrete impingement cavities or chambers 112 therebetween in cooperation with rib 90*b*, surface 90*g* and impingement plate 106. Impingement chambers 112 communicate with and open into the main coolant flow channel 114 in cavity 90. As best shown in FIG. 4, a selected number or array of impingement holes 108 are located in each impingement chamber 112 and the number and array are selected as required for adequate impingement cooling of platform 18 at that particular region. By viewing FIGS. 4 and 5, it will be noted that cooling air from area 48 passes through impingement holes 108 as a plurality of impingement cooling air jets and passes across the height $h$ of cooling chamber 90 to impinge against surface 90*g* of platform wall 18 in the impingement chambers 112. Following impingement, the cooling air passes from impingement chamber 112 into the main cooling airflow passage 114 and joins the cooling air from the other impingement jets therein and passes along channel 114 toward the vane trailing edge 64 and then enters a plurality of apertures 116 in surface 90***g*, which apertures 116 form the inlets to a plurality of cooling air passages or channels 118, which terminate in apertures 120 in inner surface 24 of platform 18 so as to flow therealong to serve to film cool the platform rail 96 laterally outboard and downstream thereof. It will be recognized that in passing through passages 118, the cooling air has served to cool the adjacent portions of platform 18 by convection cooling. In passing through main coolant passage 114 of chamber 90, the cooling air is caused to pass around one or more pedestals 122, which are cast into vane 10 so as to project from surface 90*g* and abut impingement plate 106. Pedestals 122 increase channel flow heat transfer coefficients. It will be noted that main cooling airflow passage 114 extends between inlet ports 108 and outlet ports 116 of chamber 90.

The pressure side of platform 18 is therefore cooled by a combination of impingement cooling when cooling air jets impinge surface 90*g*, convection cooling as the cooling air travels passage 114 and channels 118, and film cooling when the cooling air is discharged along surface 24 at rail 96. Dams or ribs 110 perform the very important function of forming impingement cavities 112 across which the impingement jets of cooling air which pass through impingement holes 108 are projected to impinge against surface 90*g* and isolate or protect the impingement jets from cross-flow effect of the previously impinged air passing through main cooling air channel 114. Flow dams 110 eliminate impingement flow degradation by shielding the impingement jets from main channel flow. It it were not for the presence of ribs or walls 110 and the impingement chambers 112 which they form, the previously impinged cooling air passing through main channel 114 would pass through the impingement jets in cross-flow fashion and cause them to be canted and thereby loose their impingement cooling efficiency.

Platform suction side cooling chamber 92 is formed in a similar fashion to chamber 90 and includes a continuous raised rib 92*a*, which is preferably cast to project outwardly from surface 44 of vane 14, which cooperates with surface 44 of platform 18 and impingement plate 124, which is similar to impingement plate 106 in construction and which is shaped to the shape of raised rib 92*a* and adjoined thereto in conventional fashion such as welding so as to form sealed suction side cooling air chamber or cavity 92. Impingement holes 126 constitute the only cooling air inlet ports to chamber 92 and pass through impingement plate 124 in selected array to cause cooling air which passes therethrough to form impingement jets which impinge against the surface 44 of platform 18 to cool the platform as did the impingement jets formed in pressure side chamber 90. The cooling air impingement jets are formed by the pressure differential across ports 108 and 126. Following impingement, the cooling air in chamber 92 flows across pedestals 128 and is discharged through drilled convection holes or channels 130, each of which has an inlet 132 communicating with chamber 92 and an outlet 134 in surface 24 so that the cooling air from chamber 92 is discharged through openings 134 in surface 24 so as to cool platform rail 98 in film cooling fashion. In operation, platform suction side cooling chamber 92 operates in the same fashion as previously described with respect to platform pressure side cooling chamber 90 in that cooling air enters chamber 92 as in impingement jets through impingement holes 126 in impingement plate 124 to impinge against the surface 92*b* of surface 44 (see FIG. 8) of platform 18 and then flow along the surface 92*b* of platform 18 as the impinged cooling air passes through chamber 92 and over pedestals 128 to be discharged therefrom through drilled cooling holes 130 to be discharged along surface 24 of platform 18 to film cool the platform rail 98 adjacent thereto.

It will therefore be seen that cooling chamber 92 serves to cool the suction side of platform 18 by a combination of impingement, convection and film cooling as previously described in connection with chamber 90.

The cooling of the trailing edge area 94 of platform 18 is best understood by viewing FIGS. 4 and 6. As best shown in FIG. 4, a plurality of drilled holes 136 extend into platform 18 from region 48 and each joins one or more drilled convection holes or channels 138, which extend therefrom in substantially parallel array and discharge through apertures 140 in trailing edge 64 of platform 18. It will be noted by observing FIGS. 4 and 6 that trailing edge area 94 of platform 18 is convection cooled as cooling air from area 48 enters cooling air holes 136, which are joined to convection cooling holes 138 so as to pass therethrough and to be discharged through discharge outlet 140 in platform trailing edge 64.

In view of the fact that feather seal 142 (FIG. 4) extends between adjacent vane platforms 18 and is received in aligned recesses 144 and 146 thereof (FIG. 7) so as to prevent the hot gases from passage 12 from passing between adjacent platforms 18, it is necessary that the outboard apertures be elongated slots 148 of sufficient lateral dimension to be joined to two adjacent drilled holes 132*a* and 132*b* (FIG. 4) so that cooling air from area 48 may pass through slot 148 and into adjacent drilled holes 132*a* and 132*b*. It will be realized that if 148 were not slot shaped but of circular cross section as drilled hole 136, feather seal 142 would serve to block the entrance to drilled hole 132*a*. It will accordingly be noted that platform trailing edge portion 94 is cooled by cooling air passing through a parallel array of drilled cooling holes 132 which extend in a continuous pattern between and are parallel to lateral surfaces 78 and 80 of platform 18.

I wish it to be understood that I do not desire to be limited to the exact details of construction shown and described, for obvious modifications will occur to a person skilled in the art.

I claim:

1. A turbomachinery vane or blade including:

A. an airfoil section having a leading edge, a trailing edge, a pressure side and a suction side and adapted to extend across a hot gas passage, B. a platform attached to the airfoil section at one end thereof and extending substantially laterally with respect thereto and including:

1. a leading edge portion forward of the airfoil section leading edge,
2. a trailing edge portion aft of the airfoil section trailing edge,
3. an inner surface defining the boundary of the hot gas passage, and
4. an outer surface, c. first means to cool the platform adjacent the airfoil section pressure side using a combination of impingement, convection and film cooling, D. second means to cool the platform adjacent the airfoil section suction side using a combination of impingement and film cooling, and E. third means to cool the platform trailing edge portion utilizing convection cooling.

2. A vane or blade according to claim 1 wherein said first platform cooling means includes:

A. a continuous cooling chamber located in said platform adjacent said airfoil section pressure side for substantially the full chord dimension thereof and increasing in lateral dimension in a downstream direction and including:

1. a wall member spaced from said platform outer surface and including:

a. a selected array of impingement holes extending therethrough positioned immediately adjacent the airfoil section pressure side for substantially the full chord dimension thereof and oriented to cause a selected array of impingement jets of cooling air to pass therethrough and to impinge against the platform outer surface for impingement cooling thereof in response to pressure differential thereacross, and 2. having at least one discharge channel extending from said cooling cavity to the inner surface of said platform so that the cooling air being discharged therethrough will serve to film cool the platform inner surface.

3. A vane or blade according to claim 2 wherein said cooling chamber is shaped to define a main cooling air passage therethrough extending between said impingement holes and said discharge channel and including means cooperating with said impingement jet holes to form impingement chambers which are isolated from the main cooling air passage.

4. A vane or blade according to claim 3 wherein said main cooling air passage and said impingement chambers are oriented normal to one another and in communication with one another so that the cooling air from the impingement jets may enter the main cooling air passage following impingement and so that the passage of cooling air through the main cooling air passage does not flow through the impingement jet chambers.

5. A vane or blade according to claim 4 wherein said cooling air discharge means includes a plurality of drilled holes in said platform extending between said pressure side cooling chamber and said platform inner surface at the platform rail adjacent the pressure side lateral edge so that the platform will be cooled by the first means by a combination of impingement cooling by the impingement jets, convection cooling by the cooling air flowing through the main cooling air passage and through the drilled holes, and by film cooling due to the discharge of cooling air at the platform inner surface.

6. A vane or blade according to claim 5 and including pedestal means selectively shaped and positioned in said main cooling air passage to increase heat transfer.

7. A vane or blade according to claim 1 wherein said second cooling means comprises a single cooling chamber in the platform adjacent the airfoil section suction side having a wall member spaced from the platform outer surface and connected thereto to define a continuous cooling air passage therebetween and including cooling air inlet means to said passage and cooling air discharge means from said passage.

8. A vane or blade according to claim 7 wherein said cooling air inlet means includes an array of impingement holes extending through said wall member and oriented to cause a selected array of cooling air impingement jets to impinge against the platform outer surface in response to pressure differential across the impingement holes and wherein said cooling air discharge means includes a plurality of channels extending from said cooling chamber to the inner surface of the platform so that the cooling air which enters the cooling chamber through the impingement jet holes passes through the chamber and is discharged therefrom through the channels along the platform inner surface thereby cooling the platform adjacent the airfoil section suction side by a combination of impingement, convection and film cooling.

9. A vane or blade according to claim 8 wherein said third cooling means includes a plurality of channels extending along said platform substantially parallel to the inner and outer surfaces and terminating in said platform after edge, and means joining each of said channels to the platform outer surface to admit cooling air therethrough and into the channels for discharge from the platform after edge to convection cool the platform after portion.

10. A vane or blade according to claim 9 wherein said channels are drilled holes which are substantially parallel to one another and to said pressure side lateral edge and said suction side lateral edge.

11. A vane or blade according to claim 1 wherein said second cooling means includes a continuous raised lip projecting outwardly from said vane outer surface, a plate member attached to said outer lip throughout its periphery and cooperating therewith and with said platform outer surface to define a cooling air chamber therebetween, a selective array of impingement jet holes passing through said plate member and oriented so to cause a plurality of jets of cooling air to impinge against the platform outer surface in response to pressure differential thereacross and constituting the sole cooling air entrance means to said cooling air chamber, and including a plurality of channels extending from said cooling air chamber and through said platform to said platform inner surface at the platform rail adjacent the platform suction side lateral edge so that the cooling air which enters the cooling chamber through said impingement holes serves to cool said platform by impingement cooling, then serves to cool said platform by convection cooling as it passes through said cooling chamber and said channels and finally serves to cool said platform by film cooling as it is discharged at the inner surface of the platform.

12. A vane or blade according to claim 11 and including means to seal between said platform pressure side lateral edge and suction side lateral edge and corresponding edges of adjacent vanes or blades.

13. A vane or blade according to claim 9 wherein said cooling air admission means includes a plurality of holes extending from platform outer surface and joined to said channels at a station remote from the platform after edge.

14. A vane or blade according to claim 13 wherein said cooling air admission means includes a slot shaped aperture extending from said platform outer surface and communicating with at least two of said channels.

15. A vane or blade according to claim 14 and including seal means sealing between the pressure side of lateral edge or the suction side lateral edge of the platform and corresponding edges of adjacent platforms and including a plate member partially covering said slot shaped aperture.

16. A vane or blade according to claim 1 and including a second platform connected to the other end of the airfoil section, and means to cool said second platform.

17. A turbomachinery vane or blade according to claim 1 wherein said first cooling means includes:

A. wall means shaped to define a chamber of shallow height and including and extending substantially parallel to said outer surface and for substantially the full chord dimension thereof and increasing in lateral dimension in a downstream direction, and B. cooling fluid inlet apertures in said wall means opposite said platform outer surface, immediately adjacent the airfoil section pressure side for substantially the full chord dimension thereof, said apertures being selectively shaped and oriented to direct a stream of cooling fluid therethrough to impinge against said platform outer surface in response to pressure differential across said inlet apertures, C. at least one cooling fluid exhaust aperture in said wall means selectively positioned to define a cooling fluid flow path across said chamber from said inlet apertures to said exhaust aperture, and D. dam means extending across the height of said chamber adjacent said inlet apertures and being selectively shaped to cooperate with said wall means to define a cavity separate from but communicating with the cooling fluid flow path to protect the impingement jets of cooling fluid passing through said inlet apertures from cross-flow interference from the cooling fluid passing through the cooling fluid flow path until impingement against said platform wall member has occurred.

18. A turbomachinery vane or blade including:

A. an airfoil section adapted to extend across a hot gas path and having a leading edge and a trailing edge, a chord extending between the leading and trailing edges, an inner end and an outer end, and pressure and suction sides, B. a platform connected to one end of the airfoil section and oriented to be substantially normal thereto and having:

1. a forward edge positioned forward of the airfoil section leading edge,
2. an after edge positioned aft of the airfoil trailing edge,
3. a pressure side lateral edge on the pressure side of the airfoil section,
4. a suction side lateral edge on the suction side of the airfoil section,
5. an inner surface adjacent the airfoil section to define a boundary of the hot gas path and including:
   a. a forward portion adapted to have cooling air pass thereover for film cooling thereof,
   b. lateral portions on opposite sides of the airfoil section and culminating in platform rails adjacent the pressure side lateral edge and the suction side lateral edge, and
   c. an after portion extending aft of the airfoil section and terminating in said after edge,
6. an outer surface adapted to have cooling air pass thereover for film cooling thereof, and
7. attachment means projecting from said outer surface, C. first means to cool the platform adjacent the airfoil section pressure side, D. second means to cool the platform adjacent the airfoil section suction side, E. third means to cool the after portion of the platform, F. wherein said first platform cooling means includes:

1. a continuous cooling chamber located in said platform adjacent said airfoil section pressure side and extending for substantially the full chord dimension thereof and increasing in lateral dimension in a downstream direction and including:
   a. a wall member spaced from said platform outer surface and including:
      1. a selected array of impingement holes extending therethrough positioned immediately adjacent the airfoil section pressure side for substantially the full chord dimension thereof and oriented to cause a selected array of impingement jets of cooling air to pass therethrough and to impinge against the platform outer surface for impingement cooling thereof in response to pressure differential thereacross,
   b. having at least one discharge channel extending from said cooling cavity to the inner surface of said platform so that the cooling air being discharged therethrough will serve to film cool the platform inner surface,
2. wherein said cooling chamber is shaped to define a main cooling air passage therethrough extending between said impingement holes and said discharge channel and including means cooperating with said impingement jet holes to form impingement chambers which are isolated from the main cooling air passage,
3. wherein said main cooling air passage and said impingement chambers are oriented normal to one another and in communication with one another so that the cooling air from the impingement jets may enter the main cooling air passage following impingement and so that the passage of cooling air through the main cooling air passage does not flow through the impingement jet chambers, and
4. wherein said cooling air discharge means includes a plurality of drilled holes in said platform extending between said pressure side cooling chamber and said platform inner surface at the platform rail adjacent the pressure side lateral edge so that the platform will be cooled by the first means by a combination of impingement cooling by the impingement jets, convection cooling by the cooling air flowing through the main cooling air passage and through the drilled holes, and by film cooling due to the discharge of cooling air at the platform inner surface, G. wherein said second cooling means comprises a cooling chamber in the platform adjacent the airfoil section suction side having a wall member spaced from the platform outer surface and connected thereto to define a cooling air passage therebetween and including cooling air inlet means to said passage and cooling air discharged means from said passage, and 1. wherein said cooling air inlet means includes an array of impingement holes extending through said wall member and oriented to cause a selected array of cooling air impingement jets to impinge against the platform outer surface in response to pressure differential across the impingement holes and wherein said cooling air discharge means includes a plurality of channels extending from said cooling chamber to the inner surface of the platform so that the cooling air which enters the cooling chamber through the impingement jet holes passes through the chamber and is discharged therefrom through the channels along the platform inner surface thereby cooling the platform adjacent the airfoil section suction side by a combination of impingement, convection and film cooling, H. wherein said third cooling means includes a plurality of channels extending along said platform substantially parallel to the inner and outer surfaces and terminating in said platform after edge, and means joining each of said channels to the platform outer surface to admit cooling air therethrough and into the channels for discharge from the platform after edge to convection cool the platform after portion, 1. wherein said channels are drilled holes which are substantially parallel to one another and to said pressure side lateral edge and side suction side lateral edge,
2. wherein said cooling air admission means includes a plurality of holes extending from platform outer surface and joined to said channels at a station remote from the platform after edge,
3. wherein said cooling air admission means includes a slot shaped aperture extending from said platform outer surface and communicating with at least two of said channels, and I. including seal means sealing between the pressure side lateral edge or the suction side lateral edge of the platform and corresponding edges of adjacent platforms and including a plate member partially covering said slot shaped aperture.

19. A turbomachinery vane or blade including:

A. an airfoil section adapted to extend across a hot gas path and having a leading edge and a trailing edge, a chord extending between the leading and trailing edges, an inner end and an outer end and pressure and suction sides, B. a platform connected to one end of the airfoil section and oriented to be substantially normal thereto and having:

1. a forward edge positioned forward of the airfoil section leading edge,
2. an after edge positioned aft of the airfoil trailing edge,
3. a pressure side lateral edge on the pressure side of the airfoil section,
4. a suction side lateral edge on the suction side of the airfoil section,
5. an inner surface adjacent the airfoil section to define a boundary of the hot gas path and including:
   a. a forward portion adapted to have cooling air pass thereover for film cooling thereof,
   b. lateral portions on opposite sides of the airfoil section and culminating in platform rails adjacent the pressure side lateral edge, and the suction side lateral edge, and
   c. an after portion extending aft of the airfoil section and terminating in said after edge,
6. an outer surface adapted to have cooling air pass thereover for film cooling thereof, and
7. attachment means projecting from said outer surface, C. first means to cool the platform adjacent the airfoil section pressure side, D. second means to cool the platform adjacent the airfoil section suction side, E. third means to cool the after portion of the platform, F. wherein said first platform cooling means includes:

1. a continuous cooling chamber located in said platform adjacent said airfoil section pressure side for substantially the full chord dimension thereof and increasing in lateral dimension in a downstream direction and including:
   a. a wall member spaced from said platform outer surface and including:
      1. a selected array of impingement holes extending therethrough positioned immediately adjacent the airfoil section pressure side for substantially the full chord dimension thereof and oriented to cause a selected array of impingement jets of cooling air to pass therethrough and to impinge against the platform outer surface for impingement cooling thereof in response to pressure differential thereacross, and
   b. having at least one discharge channel extending from said cooling cavity to the inner surface of said platform so that the cooling air being discharged therethrough will serve to film cool the platform inner surface,
2. wherein said cooling chamber is shaped to define a main cooling air passage therethrough extending between said impingement holes and said discharge channel and including means cooperating with said impingement jet holes to form impingement chambers which are isolated from the main cooling air passage,
3. wherein said main cooling air passage and said impingement chambers are oriented normal to one another and in communication with one another so that the cooling air from the impingement jets may enter the main cooling air passage following impingement and so that the passage of cooling air through the main cooling air passage does not flow through the impingement jet chambers, and
4. wherein said cooling air discharge means includes a plurality of drilled holes in said platform extending between said pressure side cooling chamber and said platform inner surface at the platform rail adjacent the pressure side lateral edge so that the platform will be cooled by the first means by a combination of impingement cooling by the impingement jets, convection cooling by the cooling air flowing through the main cooling air passage and through the drilled holes, and by film cooling due to the discharge of cooling air at the platform inner surface, G. wherein said second cooling means includes a continuous raised lip projecting outwardly from said vane outer surface, a plate member attached to said outer lip throughout its periphery and cooperating therewith and with said platform outer surface to define a cooling air chamber therebetween, a selective array of impingement jet holes passing through said plate member and oriented so to cause a plurality of jets of cooling air to impinge against the platform outer surface in response to pressure differential thereacross and constituting the sole cooling air entrance means to said cooling air chamber, and including a plurality of channels extending from said cooling air chamber and through said platform to said platform inner surface at the platform rail adjacent the platform suction side lateral edge so that the cooling air which enters the cooling chamber through said impingement holes serves to cool said platform by impingement cooling, then serves to cool said platform by convection cooling as it passes through said cooling chamber and said channels and finally serves to cool said platform by film cooling as it is discharged at the inner surface of the platform, H. wherein said third cooling means includes a plurality of channels extending along said platform substantially parallel to the inner and outer surfaces and terminating in said platform after edge, and means joining each of said channels to the platform outer surface to admit cooling air therethrough and into the channels for discharge from the platform after edge to convection cool the platform after portion, 1. wherein said channels are drilled holes which are substantially parallel to one another and to said pressure side lateral edge and said suction side lateral edge,
2. wherein said cooling air admission means includes a plurality of holes extending from platform outer surface and joined to said channels at a station remote from the platform after edge,
3. wherein said cooling air admission means includes a slot shaped aperture extending from said platform outer surface and communicating with at least two of said channels, and I. including seal means sealing between the pressure side of lateral edge or the suction side lateral edge of the platform and corresponding edges of adjacent platforms and including a plate member partially covering said slot shaped aperture.

* * * * *